US006716080B2

(12) United States Patent
Hoffman et al.

(10) Patent No.: US 6,716,080 B2
(45) **Date of Patent: *Apr. 6, 2004**

(54) ANODICALLY BONDED ELEMENTS FOR FLAT-PANEL DISPLAYS

(75) Inventors: James J. Hoffman, Boise, ID (US); Jason B. Elledge, Boise, ID (US); Zhong-Yi Xia, Boise, ID (US); David A. Cathey, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/205,741

(22) Filed: Jul. 25, 2002

(65) Prior Publication Data

US 2002/0193037 A1 Dec. 19, 2002

Related U.S. Application Data

(60) Continuation of application No. 10/007,089, filed on Dec. 6, 2001, now Pat. No. 6,545,406, which is a continuation of application No. 09/302,082, filed on Apr. 29, 1999, now Pat. No. 6,329,750, which is a division of application No. 08/856,382, filed on May 14, 1997, now Pat. No. 5,980,349.

(51) Int. Cl.[7] ..... H01J 9/24
(52) U.S. Cl. ..... 445/24
(58) Field of Search ..... 445/24; 313/422

(56) References Cited

U.S. PATENT DOCUMENTS

| | | | | |
|---|---|---|---|---|
| 3,397,278 A | | 8/1968 | Pomerantz et al. | |
| 3,589,965 A | | 6/1971 | Wallis et al. | |
| 4,857,799 A | | 8/1989 | Spindt et al. | |
| 4,923,421 A | | 5/1990 | Brodie et al. | |
| 5,205,790 A | | 4/1993 | Barnabe et al. | |
| 5,232,549 A | | 8/1993 | Cathey et al. | |
| 5,247,133 A | | 9/1993 | Wiemann et al. | |
| 5,342,737 A | | 8/1994 | Georger, Jr. et al. | |
| 5,486,126 A | | 1/1996 | Cathey et al. | |
| 5,561,340 A | | 10/1996 | Jin et al. | |
| 5,562,517 A | | 10/1996 | Taylor et al. | |
| 5,595,519 A | | 1/1997 | Huang | |
| 5,717,287 A | * | 2/1998 | Amrine et al. | 313/405 |
| 5,789,857 A | | 8/1998 | Yamaura et al. | |
| 5,795,206 A | | 8/1998 | Cathey et al. | |
| 5,916,004 A | | 6/1999 | Farnworth | |
| 5,980,349 A | * | 11/1999 | Hofmann et al. | 445/26 |
| 6,072,274 A | | 6/2000 | Jondrow | |
| 6,083,070 A | | 7/2000 | Watkins | |
| 6,220,913 B1 | | 4/2001 | Makita et al. | |
| 6,329,750 B1 | | 12/2001 | Hofmann et al. | |
| 6,413,135 B1 | | 7/2002 | Kim et al. | |
| 6,422,906 B1 | * | 7/2002 | Hofmann et al. | 445/24 |
| 6,545,406 B2 | | 4/2003 | Hofmann et al. | |
| 6,554,671 B1 | | 4/2003 | Hofmann et al. | |

OTHER PUBLICATIONS

Mun, J.D., et al., *Large Area Electrostatic Bonding for Macropackaging of a field Emission Display*, Inst. for Advanced Eng., Seoul, Korea (1996).

Esashi, M., et al., Anodic Bonding for Integrated Capacitive Sensors, Micro Electro Mechanical Systems, 1992 Conference, pp. 43–48 (Feb. 4–7, 1992).

Albaugh, Kevin G., *Electrode Phenomena during Anodic Bonding of Silicon to Sodium Borosilicate Glass*, J. Electrochemical Society, vol. 138, No. 10 (Oct. 1991).

* cited by examiner

*Primary Examiner*—Kenneth J. Ramsey
(74) *Attorney, Agent, or Firm*—TraskBritt

(57) ABSTRACT

A process is disclosed for anodically bonding an array of spacer columns to one of the inner major faces on one of the generally planar plates of an evacuated, flat-panel video display. The process also includes an evacuated flat-panel display having spacer structures which are anodically bonded to an internal major face of the display, as well as a face plate assembly manufactured by the aforestated process.

43 Claims, 8 Drawing Sheets

ANODICALLY BONDED ELEMENTS FOR FLAT-PANEL DISPLAYS

CROSS-REFERENCE TO RELATED APPLICATIONS

This application is a continuation of application Ser. No. 10/007,089, filed Dec. 6, 2001, now U.S. Pat. No. 6,545,406, issued Apr. 8, 2003, which is a continuation of application Ser. No. 09/302,082, filed Apr. 29, 1999, now U.S. Pat. No. 6,329,750, issued Dec. 11, 2001, which is a divisional of application Ser. No. 08/856,382, filed May 14, 1997, now U.S. Pat. No. 5,980,349, issued Nov. 9, 1999.

GOVERNMENT RIGHTS

This invention was made with government support under Contract No. DABT 63-93-C-0025 awarded by Advanced Research Projects Agency (ARPA). The Government has certain rights in this invention.

BACKGROUND OF THE INVENTION

1. Field of the Invention

This invention relates to evacuated flat-panel displays such as those of the field emission cathode and plasma types and, more particularly, to a process for forming load-bearing spacer structures for such a display, the spacer structures being used to prevent implosion of a transparent face plate toward a parallel spaced-apart back plate when the space between the face plate and the back plate is hermetically sealed at the edges of the display to form a chamber, and the pressure within the chamber is less than that of the ambient atmospheric pressure. The invention also applies to products made by such process.

2. Background of Related Art

For more than half a century, the cathode ray tube (CRT) has been the principal device for electronically displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Although liquid crystal displays (LCD's) are now used almost universally for laptop computers, contrast is poor in comparison to CRTS, only a limited range of viewing angles is possible, and battery life is still measured in hours rather than days. Power consumption for computers having a color LCD is even greater and, thus, operational times are shorter still, unless a heavier battery pack is incorporated into those machines. In addition, color screens tend to be far more costly than CRTs of equal screen size.

As a result of the drawbacks of liquid crystal display technology, field emission display technology has been receiving increasing attention by industry. Flat-panel displays utilizing such technology employ a matrix-addressable array of cold, pointed, field emission cathodes in combination with a luminescent phosphor screen.

Somewhat analogous to a cathode ray tube, individual field emission structures are sometimes referred to as vacuum microelectronic triodes. Each triode has the following elements: a cathode (emitter tip), a grid (also referred to as the gate), and an anode (typically, the phosphor-coated element to which emitted electrons are directed).

Although the phenomenon of field emission was discovered in the 1950's, it has been within only the last ten years that extensive research and development have been directed at commercializing the technology. As of this date, low-power, high-resolution, high-contrast, monochrome flat-panel displays with a diagonal measurement of about 15 centimeters have been manufactured using field emission cathode array technology. Although useful for such applications as viewfinder displays in video cameras, their small size makes them unsuited for use as computer display screens.

In order for proper display operation, which requires field emission of electrons from the cathodes and acceleration of those electrons to the phosphor-coated screen, an operational voltage differential between the cathode array and the screen of at least 1,000 volts is required. As the voltage differential increases, so does the life of the phosphor coating on the screen. Phosphor coatings on screens degrade as they are bombarded by electrons. The rate of degradation is proportional to the rate of impact. As fewer electron impacts are required to achieve a given intensity level at higher voltage differentials, phosphor life may be extended by increasing the operational voltage differential. In order to prevent shorting between the cathode array and screen, as well as to achieve distortion-free image resolution and uniform brightness over the entire expanse of the screen, highly uniform spacing between the cathode array and the screen must be maintained. During tests performed at Micron Display Technology, Inc. in Boise, Id., it was determined that, for a particular evacuated, flat-panel field emission display utilizing glass spacer columns to maintain a separation of 250 microns (about 0.010 inches), electrical breakdown occurred within a range of 1100–1400 volts. All other parameters remaining constant, breakdown voltage will rise as the separation between screen and cathode array is increased. However, maintaining uniform separation between the screen and the cathode array is complicated by the need to evacuate the cavity between the screen and the cathode array to a pressure of less than $10^{-6}$ torr, so that the field emission cathodes will not experience rapid deterioration.

Small area displays (e.g., those which have a diagonal measurement of less than 3.0 cm) may be cantilevered from edge to edge, relying on the strength of a glass screen having a thickness of about 1.25 mm to maintain separation between the screen and the cathode array. Because the displays are small, there is no significant screen deflection in spite of the atmospheric load. However, as display size is increased, the thickness of a cantilevered flat glass screen must increase exponentially. For example, a large, rectangular television screen measuring 45.72 cm (18 in.) by 60.96 cm (24 in.) and having a diagonal measurement of 76.2 cm (30 in.) must support an atmospheric load of at least 28,149 newtons (6,350 lbs.) without significant deflection. A glass screen, or face plate (as it is also called), having a thickness of at least 7.5 cm (about 3 inches) might well be required for such an application. But that is only half the problem. The cathode array structure must also withstand a like force without significant deflection. Although it is conceivable that a lighter screen could be manufactured so that it would have a slight curvature when not under stress and be completely flat when subjected to a pressure differential, with the fact that atmospheric pressure varies with altitude and as atmospheric conditions change, makes such a solution impractical.

A more satisfactory solution to cantilevered screens and cantilevered cathode array structures is the use of closely spaced, load-bearing, dielectric spacer structures, each of which bears against both the screen and the cathode array plate, thus maintaining the two plates at a uniform distance between one another, in spite of the pressure differential between the evacuated chamber between the plates and the outside atmosphere. By using load-bearing spacers, large area displays might be manufactured with little or no increase in the thickness of the cathode array plate and the screen plate.

Load-bearing spacer structures for field-emission cathode array displays must conform to certain parameters. The spacer structures must be sufficiently nonconductive to prevent catastrophic electrical breakdown between the cathode array and the anode (i.e., the screen). In addition to having sufficient mechanical strength to prevent the flat-panel display from imploding under atmospheric pressure, they must also exhibit a high degree of dimensional stability under pressure. Furthermore, they must exhibit stability under electron bombardment, as electrons will be generated at each pixel location within the array. In addition, they must be capable of withstanding "bakeout" temperatures of about 400° C. that are likely to be used to create the high vacuum between the screen and the cathode array back plate of the display. Also, the material from which the spacers are made must not have volatile components which will sublimate or otherwise outgas under low pressure conditions.

For optimum screen resolution, the spacer structures must be nearly perfectly aligned to array topography, and must be of sufficiently small cross-sectional area so as not to be visible. Cylindrical spacers must have diameters no greater than about 50 microns (about 0.002 inch) if they are not to be readily visible. For a single cylindrical lead oxide silicate glass column having a diameter of 25 microns (0.001 in.) and a height of 200 microns (0.008 in.), a buckle load of about $2.67\times10^{-2}$ newtons (0.006 lb.) has been measured. Buckle loads, of course, will decrease as height is increased with no corresponding increase in diameter. It is also of note that a cylindrical spacer having a diameter d will have a buckle load that is only about 18 percent greater than that of a spacer of square cross-section and a diagonal d, although the cylindrical spacer has a cross-sectional area about 57 percent greater than the spacer of square cross-section. If lead oxide silicate glass column spacers having a diameter of 25 microns and a height of 200 microns are to be used in the 76.2 cm diagonal display described above, slightly more than one million spacers will be required to support the atmospheric load. To provide an adequate safety margin that will tolerate foreseeable shock loads, that number would probably have to be doubled.

There are a number of drawbacks associated with certain types of spacer structures which have been proposed for use in field emission cathode array type displays. Spacer structures formed by screen or stencil printing techniques, as well as those formed from glass balls, lack a sufficiently high aspect ratio. In other words, spacer structures formed by these techniques must either be so thick that they interfere with display resolution or so short that they provide inadequate panel separation for the applied voltage differential. It is impractical to form spacer structures by masking and etching deposited dielectric layers in a reactive-ion or plasma environment, as etch depths on the order of 0.250 to 0.625 mm would not only greatly hamper manufacturing throughput, but would result in tapered structures (the result of mask degradation during the etch). Likewise, spacer structures formed from lithographically defined photoactive organic compounds are totally unsuitable for the application, as they tend to deform under pressure and to volatize under both high-temperature and low-pressure conditions. The presence of volatized substances within the evacuated portion of the display will shorten the life and degrade the performance of the display. Techniques which adhere stick-shaped spacers to a matrix of adhesive dots deposited at appropriate locations on the cathode array back plate are typically unable to achieve sufficiently accurate alignment to prevent display resolution degradation, and any misaligned stick which is adhered to only the periphery of an adhesive dot may later become detached from the dot and fall on top of a group of nearby cathode emitters, thus blocking their emitted electrons. In addition, if an organic epoxy adhesive is utilized for the dots, the epoxy may volatize over time, leading to the problems heretofore described. For spacers formed in a mold, the need to extract the spacers from the mold requires either tapered spacers or a selectively etchable mold release compound. If the spacers are tapered, maximum spacer height is limited by the conflicting goals of maintaining compression strength (a function of the spacer's cross-sectional area at the thinnest, weakest portion) while maintaining near invisibility (a function of the spacer's cross-sectional area at the thickest, strongest portion). The use of mold release compounds, on the other hand, may greatly increase production processing times.

The present invention employs certain elements of a process disclosed in U.S. Pat. No. 5,486,126 ("the '126 patent"). The '126 patent, which is hereby incorporated in this document by reference, teaches the fabrication of an evacuated flat-panel display from specially formed spacer slices. Each spacer slice may be characterized as a matrix which includes permanent, bondable glass fiber strands imbedded in a filler material that is selectively etchable with respect to the permanent glass fiber strands. The spacer slices are fabricated by forming a fiber strand bundle having an ordered arrangement of permanent glass fiber strands and filler material strands. The bundle, or a closely packed array of multiple bundles, is sawed into laminar slices and polished to have a final thickness corresponding to a desired spacer height. Multiple spacer slices are positioned on either a display base plate or a display face plate (for a field emission display, the face plate is a transparent laminar plate that will be coated with phosphor dots or rectangles; the base plate incorporates the field emitters, as well as the circuitry required to activate the field emitters), to which adhesive dots have been applied at desired spacer locations thereon. Once the adhesive dots have set up, the filler material within the spacer slices is etched away. Any unbonded permanent spacer columns are also washed away in the etch process. An array of permanent spacer columns remains on the base plate or face plate. The other opposing display plate is then positioned on top of the display plate to which the spacers have been affixed, the cavity between the face plate and the base plate is evacuated, and the edges of the face plate and base plate are sealed so as to hermetically seal the cavity.

What is needed is a new method of manufacturing dielectric, load-bearing spacer structures for use in field emission cathode array-type displays. Ideally, the resulting spacer structures will resist deformation under pressure, have high aspect ratios, have a constant cross-sectional area throughout their lengths, have near-perfect alignment on both the screen and backplate, and require no adhesives which may volatize under conditions of very low pressure.

SUMMARY OF THE INVENTION

The invention includes a process for anodically bonding silicate glass elements to larger assemblies in a flat-panel video display. The invention is disclosed in the context of bonding an array of spacer columns to one of the inner major faces on one of the generally planar plates of a flat-panel field emission video display. The process includes the steps of: providing a generally planar plate having a plurality of spacer column attachment sites; providing electrical interconnection between all attachment sites; coating each attachment site with a patch of oxidizable material; providing an array of unattached glass spacer columns, each unattached spacer column being of uniform length and being positioned longitudinally perpendicular to a single plane, with the plane intersecting the midpoint of each unattached spacer column; positioning the array such that an end of one spacer column is in contact with the oxidizable material patch at each attachment site; and anodically bonding the contacting end of each spacer column to the oxidizable material layer.

For a preferred embodiment of the process, the spacer column attachment sites are located on the inner major face of a transparent glass face plate. Electrical contact between all attachment sites is made by depositing a layer of a transparent, solid conductive material, such as indium tin oxide or tin oxide, on the entire surface of the inner major face. A silicon layer is deposited on top of the transparent conductive layer and patterned to form the oxidizable material patches.

Additionally, for a preferred embodiment of the process, provision of the array of unattached glass spacer columns includes the steps of: preparing a tightly packed, glass fiber bundle which is a matrix of permanent glass fibers imbedded within filler glass which is selectively etchable with respect to the permanent glass fibers; sintering the glass fiber bundle in order to fuse each glass fiber within the glass fiber bundle to surrounding glass fibers; drawing the bundle in order to reduce the size of the permanent glass fibers and the surrounding filler glass; cutting the drawn bundles into shorter, intermediate bundles; tightly packing the intermediate bundles into a generally rectangular block; sintering the packed intermediate bundles into a rigid rectangular block; sawing the rigid blocks to form a uniformly thick laminar spacer slice having a pair of opposing major surfaces and with the permanent glass fiber sections embedded therein being longitudinally perpendicular to the major surfaces; and polishing both major surfaces of the laminar slice to a final thickness which corresponds to a desired spacer length.

Also, for a preferred embodiment of the process, an anti-reflective layer is deposited on the glass face plate, followed by the deposition of an opaque, or nearly opaque, layer. The opaque layer, which may contain a material such as a colored transition metal oxide, is patterned to form a matrix which serves as a contrast mask during display operation. These deposition and patterning steps are performed prior to depositing the transparent conductive layer.

The invention also includes a flat-panel display having spacer columns which are anodically bonded to an internal major face of the display, as well as a face plate assembly manufactured by the aforestated process.

BRIEF DESCRIPTION OF THE SEVERAL VIEWS OF THE DRAWING

It should be noted that, because of the great disparity in size between various features depicted in the same drawing, the following drawings are not necessarily drawn to scale; it is intended that they be merely illustrative of the process.

DETAILED DESCRIPTION OF THE INVENTION

The present invention will be described in the context of a process for fabricating a face plate assembly, which includes a laminar face plate panel and an array of attached spacers, for an evacuated flat-panel video display. The process of the present invention differs from that of the heretofore described '126 patent in at least two important respects. Firstly, each of the spacers of the face plate assembly manufactured in accordance with the present invention is anodically bonded to the laminar face plate panel. Secondly, the fabrication of spacer slices has been extensively modified for use in the anodic bonding process, with glass material being utilized for both the spacers and the filler material. The new process will be described with reference to a series of drawing figures in the following sequence: the preferred method of fabricating all-glass spacer slices; preparation of a face plate assembly for the anodic bonding operation; the actual process of anodically bonding the spacer slice to the prepared face plate assembly; and removal of the filler glass and unbonded spacers.

Figure 1:
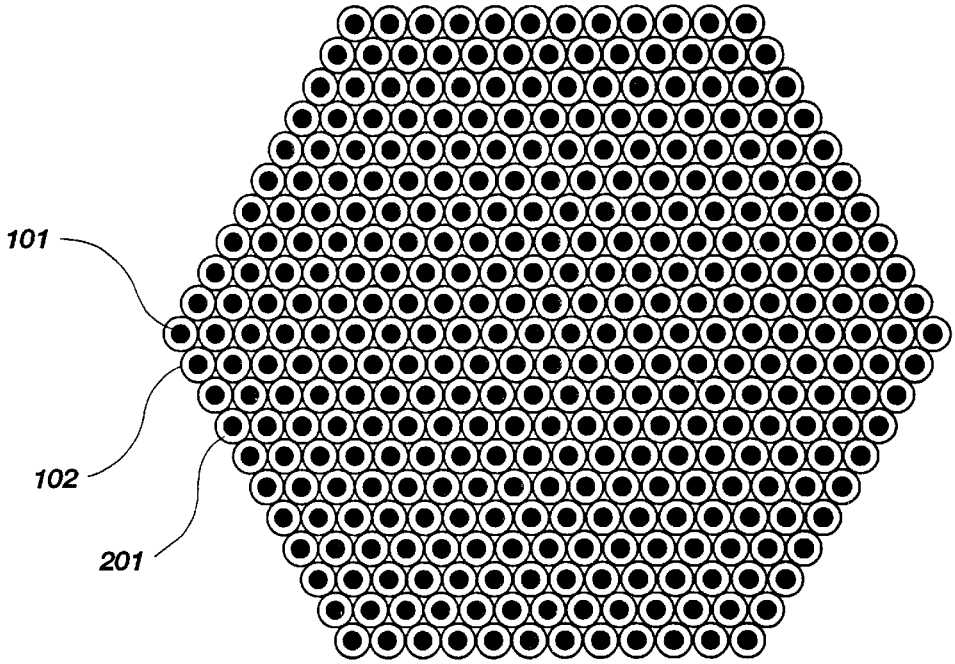
FIG. 1 depicts a cross-sectional view through a hexagonally packed fiber strand bundle constructed from permanent glass fiber strands, each of which is concentrically coated with filler glass cladding.

Preparation of the spacer slices requires a rather complex, multi-step process. For cylindrical spacer columns, a fiber strand bundle is prepared by hexagonally packing a large number of glass fiber strands of identical diameter into a bundle of preferably hexagonal cross-section. With hexagonal packing, each fiber strand (except those at the peripheral surface of the bundle) is surrounded by six other fiber strands. Referring now to FIG. 1, which is a cross-sectional view through a representative hexagonally packed bundle, each cylindrical fiber strand 201 has a permanent glass fiber core 101 covered by a filler glass cladding 102 which can be etched selectively with respect to the permanent glass fiber core 101. It will be noted that the hexagonally packed bundle depicted in FIG. 1 has a hexagonal cross-section. Although this is deemed to be the preferred arrangement for a hexagonally packed fiber strand bundle, a satisfactory arrangement may also be achieved by surrounding a single permanent glass fiber with six filler glass fibers and using the resulting seven-strand group as a repeating unit for the entire bundle. The preferred arrangement, however, provides greater flexibility with regard to distances between permanent fibers, while requiring a total number of fewer fibers to complete a bundle.

Figure 2:
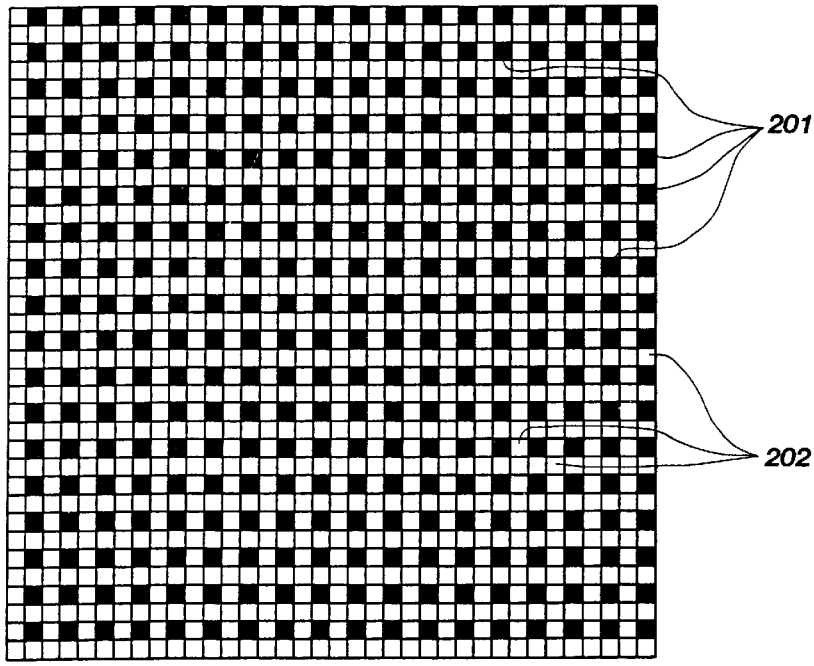
FIG. 2 depicts a cross-sectional view through a cubically packed fiber strand bundle having a repeating pattern of permanent and filler glass fibers.

For spacer columns having a square cross-section, the preferred embodiment fiber strand bundles is produced by cubically packing permanent glass fiber strands within a matrix of filler glass fiber strands. With such an arrangement, both the permanent fiber strands and the filler fiber strands have identical square cross-sectional dimensions. FIG. 2 depicts a cross-sectional view through a cubically packed fiber strand bundle. Each permanent fiber strand 201 is imbedded within a sea of filler fiber strands 202. The ratio of permanent fiber strands 201 to filler fiber strands for the depicted matrix is 1:3. It is also possible to utilize fiber strands of rectangular cross-section (not shown), which can be stacked one on top of the other or alternatingly overlapped as in a brick wall. Although stacking one on top of the other can produce a bundle of perfect rectangular cross-section, alternatingly overlapped stacking will produce a bundle of generally rectangular cross-section. Two of the four sides will not be smooth, however, unless filled in by terminating strands at the surface which are half the size of the normal size strands.

For what is presently considered to be the preferred embodiment of the invention, the glass materials used for the spacer slices have coefficients of expansion which are similar to the coefficient of expansion of the laminar glass panel from which the face plate is constructed. Such a condition, of course, ensures that stress will be minimized during the anodic bonding process. Currently, lead oxide silicate glasses are used for the permanent fiber strands and have the following chemical composition: 35–45% PbO; 28–35% $SiO_2$; balance $K_2O$, $Li_2O$ and RbO. The most significant difference in the composition of the currently utilized filler strands is that the percentage of PbO is typically greater than 50%. The difference in lead composition is primarily responsible for the etch selectivity between the permanent fiber strands and the filler strands. However, there are many other known combinations of glass formulations that will provide both similar coefficients of expansion and selective etchability.

Once the fibers are tightly and accurately packed to form a bundle, the bundle is uniformly heated to the sintering temperature (i.e., the temperature at which all the constituent fibers fuse together along contact lines or contact surfaces). The bundle is then drawn at elevated temperature in a drawing tower, which uniformly reduces the diameter of all fibers, while maintaining a constant relative spacing arrangement between fibers. The bundle, after being drawn, may be cut into short lengths and redrawn. After drawing the bundle one or more times, the finally drawn bundle is cut into equal-length rods. After the final drawing, the permanent glass fibers within the drawn bundle have achieved the proper diameter or rectangular cross-section for the intended display, with the spacing between permanent glass fibers corresponding to the spacing between anodic bonding attachment sites of the intended display. The rods, all of which are virtually identical in shape, are then packed in a fixture to form a rectangular block. A single plane is perpendicular to and intersects the midpoint of each rod. As hexagonal rods will not pack perfectly to form a rectangular solid, partial filler rods may be used on the periphery of the rectangular block. The rectangular block is then heated to the sintering temperature in order to fuse all rods and partial filler rods into a rigid rectangular block. After cooling, the rigid block is sawed, perpendicular to the individual fibers, into uniformly thick, rectangular laminar slices. For a 1,500 volt, flat-panel, field-emission display, spacers approximately 380 microns in length (about 0.015 inch) are required to safely prevent shorting between the face plate and the base plate. Thus, slices somewhat greater than 400 microns in thickness are cut from the rigid block, and each slice is polished smooth on both major surfaces until the final thickness of each is 380 microns.

As certain temperature-related terms will be used hereinafter, a definition of each is in order. For a particular glass, the strain temperature ($T_S$) is the temperature below which further cooling of the glass will not induce permanent stresses therein; the anneal temperature ($T_A$) is the temperature at which all stresses are relieved in 15 minutes; and the transformation temperature ($T_G$) is the temperature above which all silicon tetrahedra that make up the glass have freedom of rotational movement. At the transformation temperature, most network modifier atoms are ionized and atoms such as sodium, lithium, and potassium are able to diffuse throughout the glass matrix with little resistance. For glass materials, the following relationship is true: $T_S<T_A<T_G$.

A laminar silicate glass substrate (soda lime silicate glass is presently the preferred material), which will be transformed into the face plate of the display, is subjected to a thermal cycle in order to dimensionally stabilize it. During a typical thermal stabilization process, the substrate is heated from 20° C. (room temperature) to 540° C. over a period of about 3 hours. The substrate is maintained at 540° C. for about 0.5 hours. Then, over a period of about 1 hour, it is cooled to 500° C., and then down to 20° C. over a period of about 3 hours. For the particular glass substrate used for the preferred embodiment of the invention, $T_S$ is approximately 528° C.; $T_A$ is approximately 548° C.; and $T_G$ is approximately 551° C. It should be noted that chemical reactivity of the glass substrate is of no consequence, as only a thin silicon layer that will be subsequently deposited on the substrate is responsible for the anodic bonding reaction.

The cross-sectional drawings of FIGS. 3 through 6 depict the process employed to prepare the dimensionally stabilized laminar glass substrate 301 for both the anodic bonding process and for use as a display screen. When the verb "patterned" is employed in this description or in the appended claims, it is intended to inclusively refer to the multiple steps of depositing a photoactive layer, such as photoresist, on top of a structural layer, exposing and developing the photoactive layer to form a mask pattern on top of the structural layer and, finally, selectively removing portions of the structural layer which are exposed by the mask pattern by a material removal process such as wet chemical etching, reactive-ion etching, or reactive sputtering, in order to transfer the mask pattern to the etchable layer.

Figure 3:
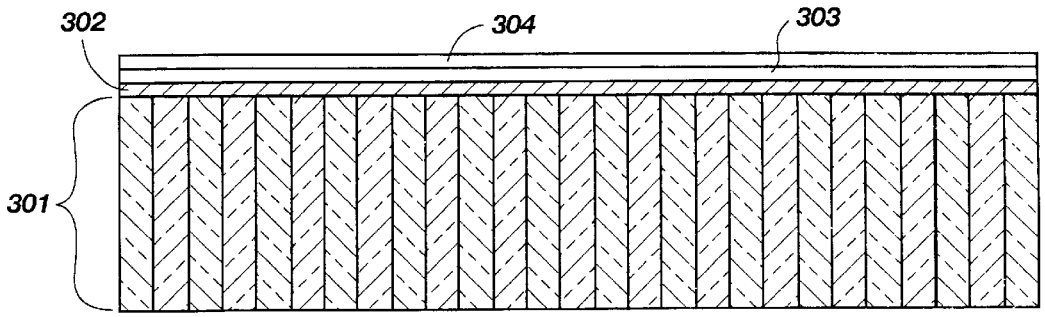
FIG. 3 depicts a cross-sectional view of a dimensionally stabilized substrate following deposition of an anti-reflective layer thereupon, deposition of an opaque layer on top of the anti-reflective layer, and masking of the latter layer.

Referring now to FIG. 3, for a preferred embodiment of the process, the dimensionally stabilized glass substrate 301 is coated with an anti-reflective layer 302 of a material such as silicon nitride. The anti-reflective layer 302 has an optical thickness of about one-quarter the wavelength of light in the middle of the visible spectrum, or about 650 Å in the case of silicon nitride. The anti-reflective layer 302 reduces the reflectivity of a subsequently deposited opaque layer from near 80 percent to about 3 percent. Following the deposition of the anti-reflective layer 302, an opaque, or nearly opaque, layer 303 is deposited to a thickness of about 1,000 to 2,000 Å on top of the anti-reflective layer 302. The opaque layer 303 is preferably an oxide of a transition metal such as cobalt or nickel. The opaque layer 303 is then coated with photoresist resin that is exposed and developed to form a matrix pattern mask 304.

Figure 4:
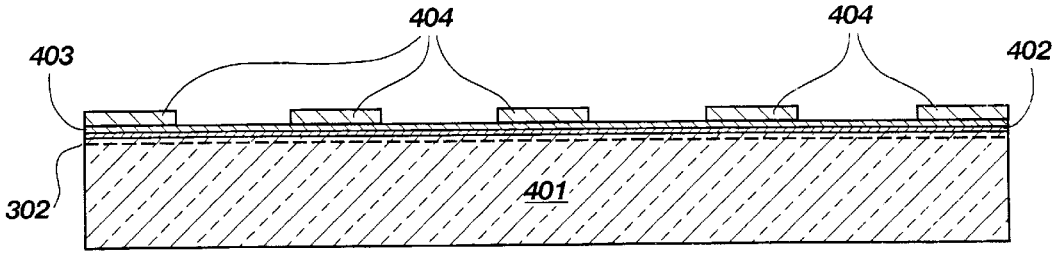
FIG. 4 depicts a cross-sectional view of the processed substrate of FIG. 3 following the etching of the opaque layer, deposition of a transparent, solid conductive layer, deposition of an oxidizable material layer, and masking of the latter layer.
Figure 7:
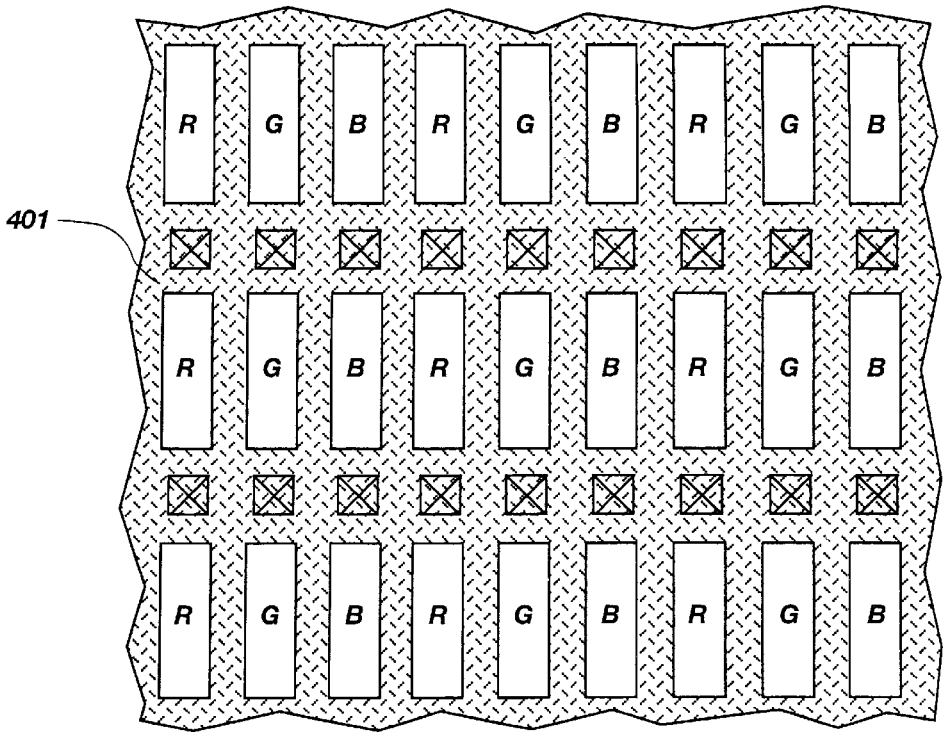
FIG. 7 depicts a top plan view of a preferred embodiment "black" matrix pattern for a display using Sony Trinitron® scanning.
Figure 8:
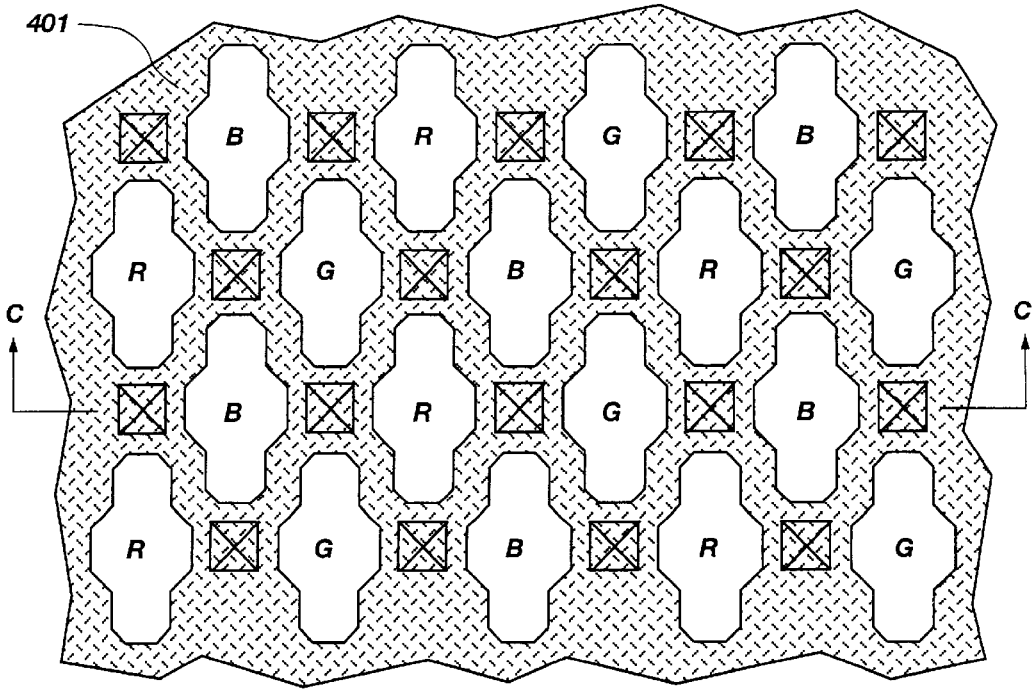
FIG. 8 depicts a top plan view of a preferred embodiment "black" matrix pattern for a conventionally scanned color display.

Referring now to FIG. 4, the opaque layer 303 is etched to form a "black" matrix 401, which surrounds transparent regions where the anti-reflective layer 302 is exposed. It is in these exposed regions that, for a colored display, luminescent red, green and blue phosphor dots will be deposited. The black matrix 401 has several functions. It will serve as a contrast mask for projected images during display operation. It is also etched with alignment marks, preferably near the outer edges of the glass substrate 301. The phosphor dot printing or deposition process will be aligned to these alignment marks. These alignment marks are also used to optically align the phosphor dots on the screen to the corresponding field emitters on the base plate when the face plate and the base plate are assembled and the edges sealed. So that they will be undetectable to the viewer, the spacer columns will be attached in the regions covered by the black matrix 401. FIG. 7 depicts a preferred embodiment pattern of black matrix 401 for a display using Sony Trinitron® scanning, while FIG. 8 depicts a preferred embodiment pattern for a conventionally scanned color display. For each figure, an "X" marks each preferred site for spacer column attachment. FIGS. 3–6 and 9–12 are cross-sectional views taken through line C—C of the black matrix pattern of FIG. 8.

Still referring to FIG. 4, the anti-reflective layer 302 and the black matrix 401 are covered with a 2,500 Å-thick conductive layer 402 of a transparent, solid, conductive material, such as indium tin oxide or tin oxide. During display operation, a voltage potential will be applied to the entire screen via the conductive layer 402. This applied voltage potential will cause electrons which are emitted from the field emitters (not yet identified) located on the base plate to accelerate until they collide with the phosphor dots deposited on the face plate. An oxidizable material layer 403, having a thickness of about 3,200 Å, is then deposited via chemical vapor deposition or physical vapor deposition (i.e., sputtering) on top of the conductive layer 402. The oxidizable material layer 403 may be silicon (presently the preferred material), a metal which oxidizes under the conditions prevailing during the anodic bonding process hereinafter described, or many other oxidizable materials which are compatible with both the manufacturing process and the specifications of the final product. The oxidizable material layer 403 is then coated with photoresist resin that is exposed and developed to form an attachment site pattern mask 404.

Figure 5:
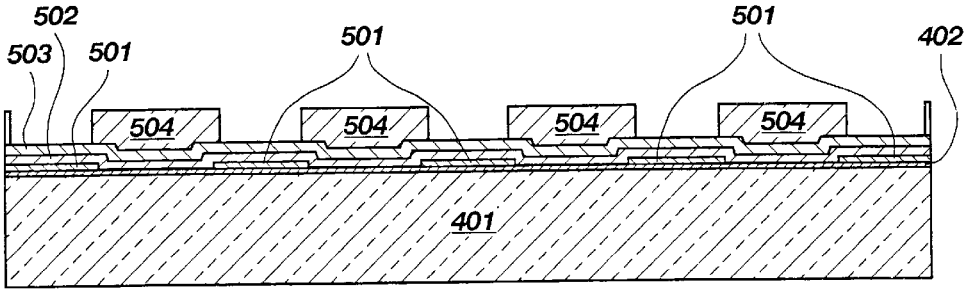
FIG. 5 depicts a cross-sectional view of the processed substrate of FIG. 4 following the etching of the oxidizable material layer, deposition of a protective sacrificial layer, and masking of the latter layer.

Referring now to FIG. 5, an etch step has transferred the attachment site pattern of mask 404 to the underlying oxidizable material layer 403, leaving a square oxidizable material patch 501 about 35 microns on a side at each of the spacer column attachment sites on the glass substrate 301. Following this etch step, a protective sacrificial layer 502 of a material such as cobalt metal (the presently preferred material), aluminum metal, chromium metal, molybdenum metal, or even cobalt oxide is blanket deposited over the oxidizable material patches 501 and over the conductive layer 402. The material from which the protective sacrificial layer 502 is formed must be selectively etchable with respect to the material from which the oxidizable material patches 501 are formed. This requirement still affords wide latitude in the choice of materials. The protective sacrificial layer 502 is then coated with photoresist resin 504 that is exposed and developed to form an attachment site clearing pattern mask 503. Mask 503 is approximately a reverse image of the pattern of mask 404.

Figure 6:
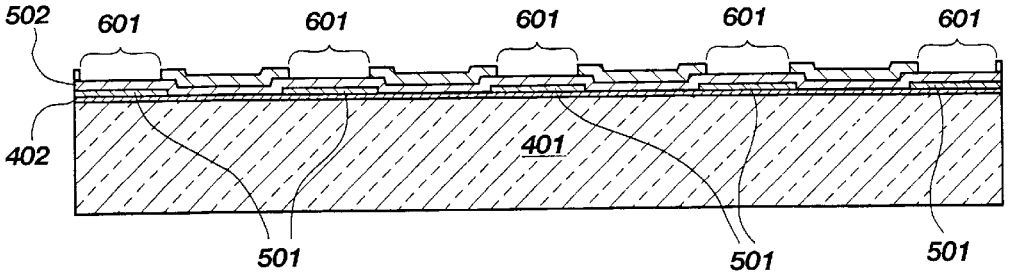
FIG. 6 depicts a cross-sectional view of the processed substrate of FIG. 5 following the etching of the protective sacrificial layer.

Referring now to FIG. 6, the protective sacrificial layer 502 has been etched to expose each oxidizable material patch 501 and leave about a five-micron-wide channel 601 around each oxidizable material patch 501, which exposes the transparent conductive layer 402 directly below.

Figure 9:
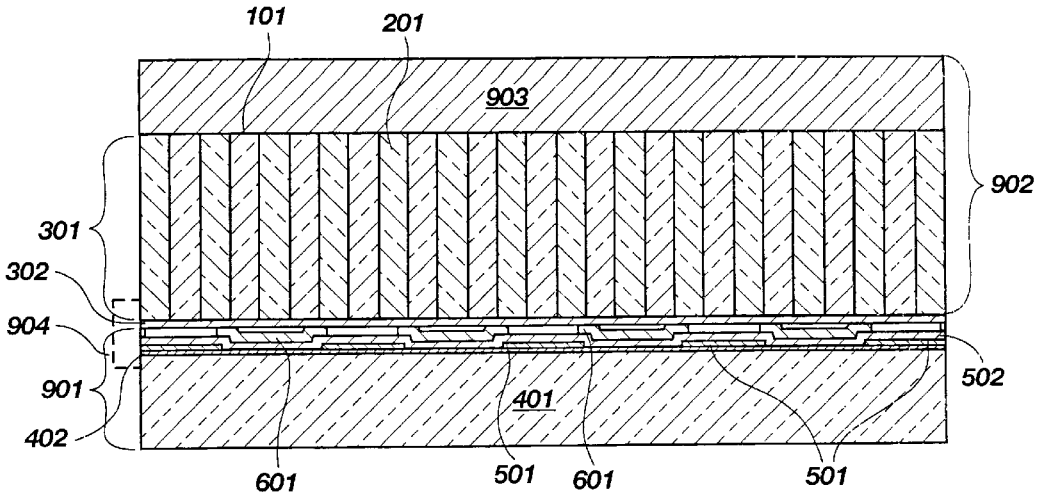
FIG. 9 depicts a cross-sectional view of the processed substrate of FIG. 6 following the placement of a hexagonally packed slice thereupon.

The remaining portion of the process, depicted by FIGS. 9 through 12, is primarily concerned with anodic bonding of the spacer slice to the face plate, prepared as described above. Referring now to FIG. 9, a polished, uniformly thick spacer slice 902 is positioned on the prepared face plate 901, with the oxidizable material patches 501 and the protective sacrificial layer 502 of the face plate 901 in contact with the spacer slice 902. For a large display, it is necessary to tile the spacer slices, as accuracy of permanent fiber spacing is difficult to maintain within a fiber bundle having a diameter greater than about 5 cm. A metal foil electrode 903 (aluminum works well) is spread on the major surface of the spacer slice 902 which is not in contact with the face plate 901. The foil electrode 903 will function as the cathode during the anodic bonding process. Electrical contact is then made to the transparent, solid, conductive layer 402 by, for example, fastening a metal spring clip 904 to the protective layer 502 on the face plate 901. Because of the presence of the transparent conductive layer 402 (which functions as the anode during the anodic bonding process), both the protective layer 502 (which covers future phosphor areas of the face plate) and the oxidizable material patches 501 (the spacer column attachment sites) are all electrically interconnected.

Figure 10:
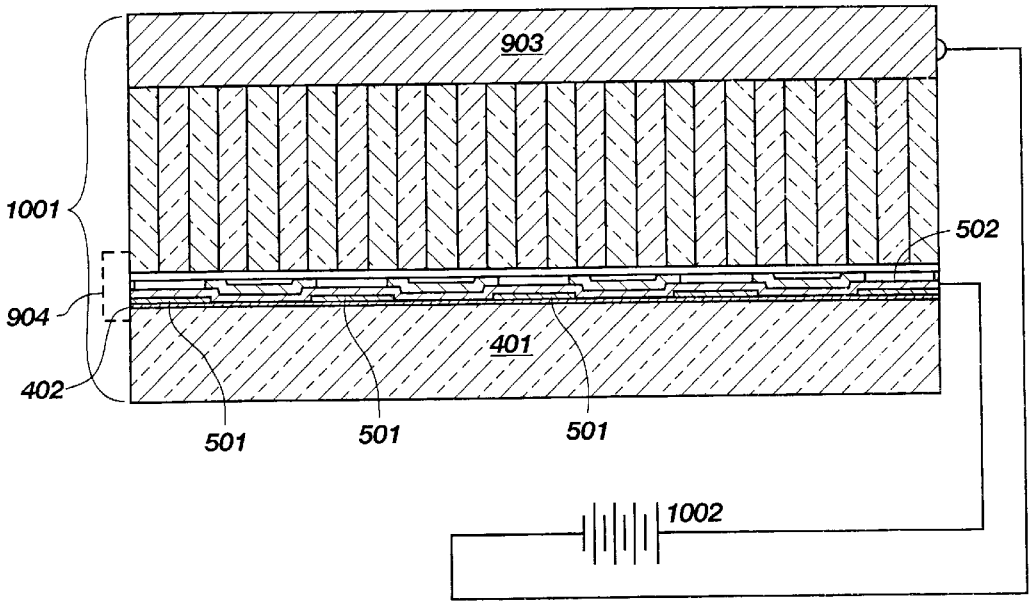
FIG. 10 depicts a cross-sectional view of the processed substrate/spacer slice assembly connected to a DC voltage source.

Referring now to FIG. 10, the face plate/spacer slice assembly 1001 is placed in an oven (not shown). In the oven, the face plate/spacer slice assembly 1001 is heated to a temperature within a range of about 280° C. to 500° C. For the type of permanent glass fibers utilized in the spacer slice 902, as heretofore described, the optimum temperature range is believed to be its transformation temperature, or $T_G$, which is about 492° C., plus or minus several degrees. A voltage within a range of about 500 to 1,000 volts, provided by voltage source 1002, is applied between the metal foil electrode 903 and the transparent conductive layer 402. The liberated, positively charged, lithium and/or sodium ions are attracted to the negatively charged electrode (i.e., the aluminum foil cathode), leaving behind a negative fixed charge in the bulk of the spacer glass. Some nonbridging oxygen atoms within both the permanent and filler glass columns of the spacer slice are also ionized. In their ionized state, they are strongly attracted to the positively charged materials (i.e., the oxidizable material patches 501 and the protective layer 502) overlying the transparent, conductive layer 402. Where portions of the spacer slice 902 overlie an oxidizable material patch 501, these oxygen ions chemically react with the atoms with which they are in contact on the surface of the underlying oxidizable material patch 501 to form a silicon dioxide fusion layer 1003 (please refer to FIG. 13), which fuses all permanent and filler glass columns to the underlying silicon patch. Where glass columns of the spacer slice 902 overlie the protective sacrificial layer 502, the oxygen ions from the glass columns chemically react with the atoms with which they are in contact on the surface of the underlying protective sacrificial layer 502. Although there is some flowing and creeping of both the permanent and filler glass material during the anodic bonding process in regions where glass columns of the spacer slice overlie the 5-micron-wide channel 601 surrounding each oxidizable material patch 501, anodic bonding is somewhat hampered.

Effectiveness of the anodic bonding process is highly dependent on the flatness of the two surfaces (i.e., those of the spacer slice 902, and those of the prepared face plate 901) which are in intimate contact with one another. In addition, the surfaces must be free of extraneous particles which would preclude contact over the entire surface. Upon contact, the two materials form a junction. Oxygen ions in the glass are drawn across the interface and form a chemically bonded oxide bridge between the glass columns in the spacer slice and whatever material overlies the transparent, conductive layer on the face plate. The anodic bonding process is self-limiting and takes roughly 10–15 minutes to complete, depending on the strength of the applied field, the alkali metal (i.e., sodium, lithium, and potassium) content of the glass, and the prevailing temperature.

Figure 11:
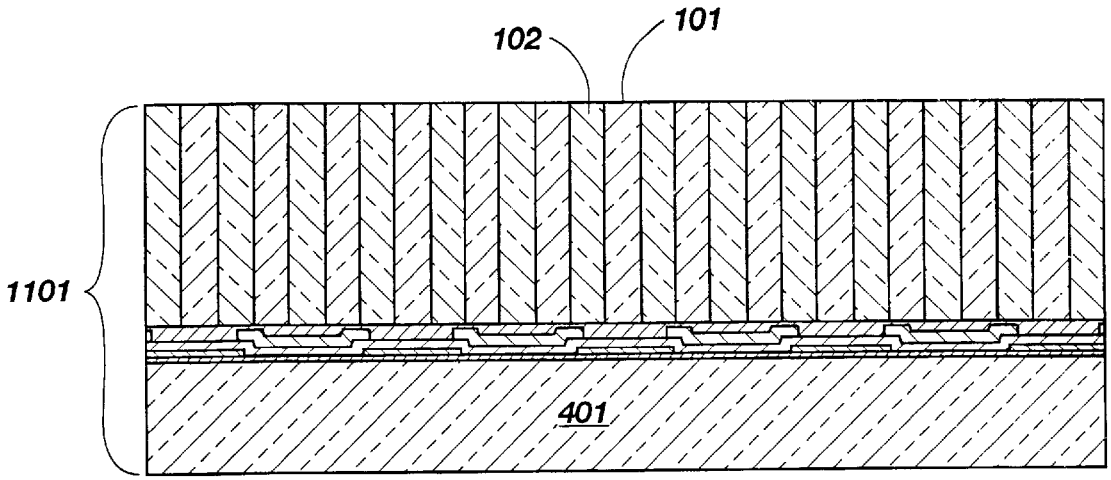
FIG. 11 depicts a cross-sectional view of the processed substrate/spacer slice assembly following anodic bonding of the wafer slice thereto.

FIG. 11 depicts the anodically bonded substrate/spacer slice assembly 1101. It will be noted that during the anodic bonding process, the gaps that existed between the face plate and the spacer slice 902 as a result of uneven topography on the face plate have been filled in. This is likely caused both by the electrostatic force employed during the anodic bonding step which forced the spacer slice against the face plate, and by the migration of silicon and oxygen atoms into the gaps.

Figure 12:
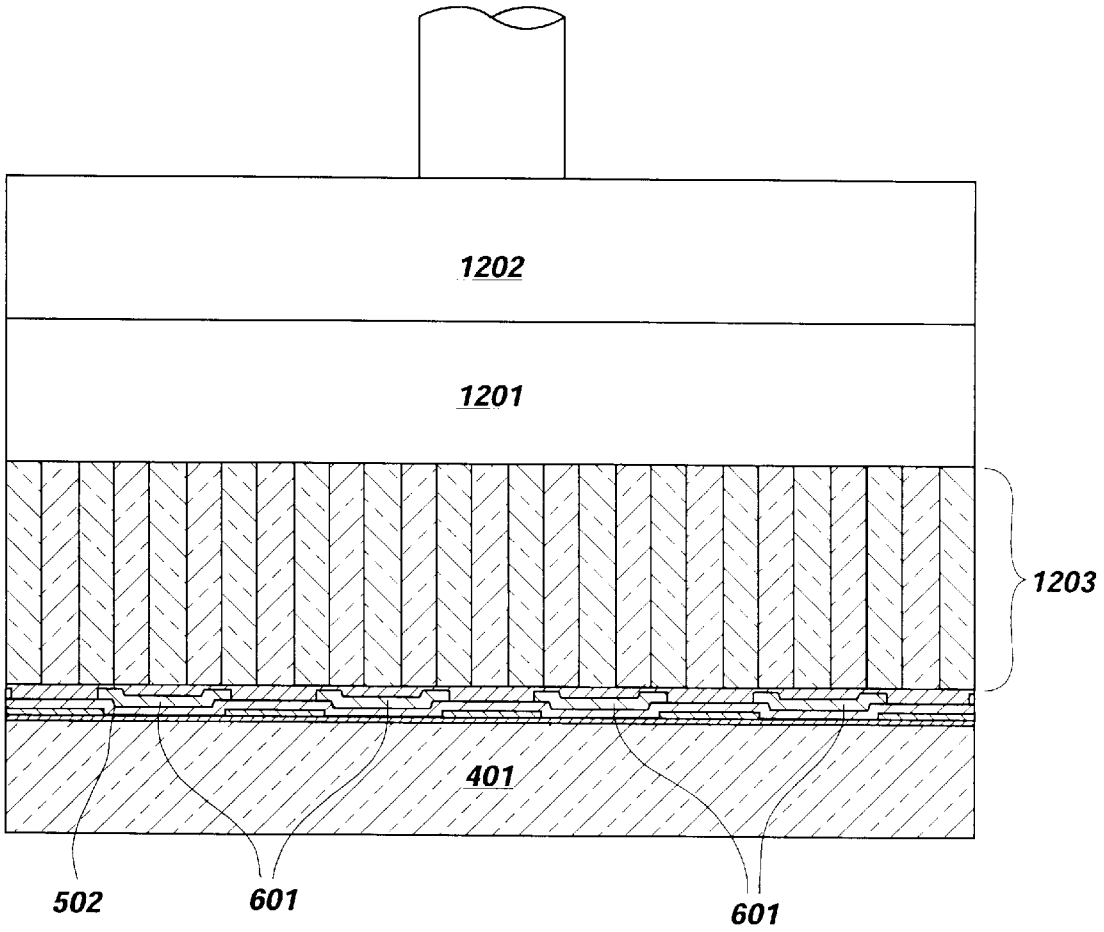
FIG. 12 depicts a cross-sectional view of the anodically bonded substrate/spacer slice assembly of FIG. 11 during an optional chemical-mechanical planarization step.

Referring now to FIG. 12, an optional polishing step is shown being performed on the anodically bonded substrate/spacer slice assembly. Chemical-mechanical polishing is believed to be the preferred polishing technique. For the chemical-mechanical polishing operation, a circular polishing pad 1201 mounted on a rotating polishing wheel 1202 is wetted with a slurry (not shown) containing both an abrasive powder and a chemical etchant and brought into controlled contact with the upper surface of the anodically bonded spacer slice 1203. The chemical-mechanical polishing step is utilized to eliminate any significant deviations from planarity on the upper surface of the bonded spacer slice. A nonplanar upper surface on the anodically bonded spacer slice 1203 might result in uneven spacer loading in the completed display, with only a portion of the permanent spacers bearing the atmospheric load. Such a condition would likely increase the probability of spacer failure. It should be noted that if the bonded spacer slice 1203 is to be polished in this optional step, the unbonded spacer slice 902 must be made slightly thicker than the desired final thickness to accommodate removal of material during the post-anodic-bonding polishing step.

Figure 13:
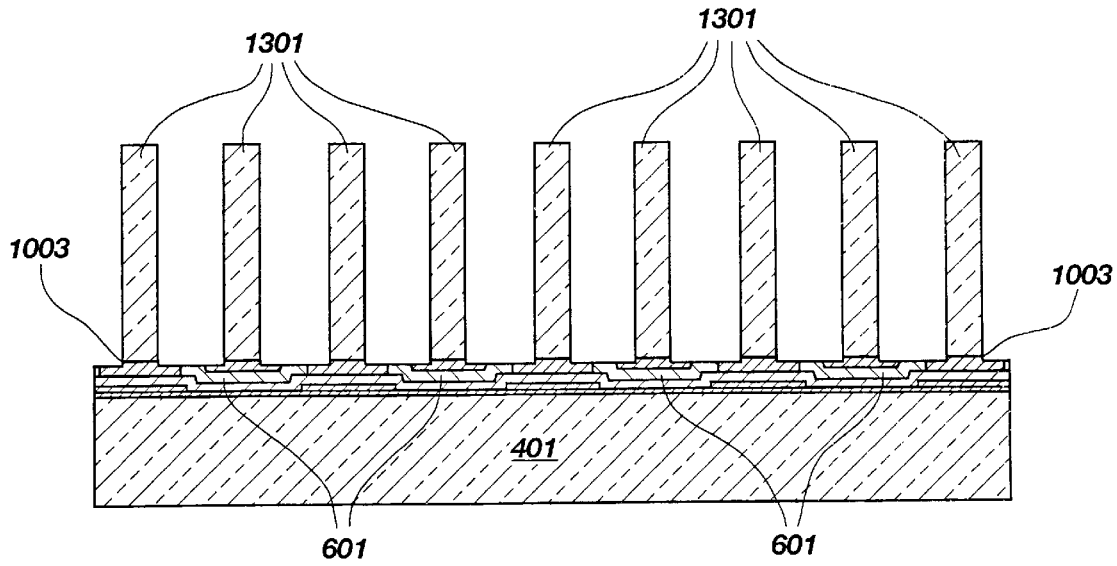
FIG. 13 depicts a cross-sectional view of the bonded substrate/spacer slice assembly of FIG. 11 or FIG. 12 following an etch step which removes the matrix glass.

Referring now to FIG. 13, the filler glass cladding 102 (filler fiber strands 202 in the case of cubically packed strands) and any unbonded permanent fiber cores 101 (permanent glass fiber strands 201 in the case of cubically packed strands) are etched away in a 20° to 40° C. acid bath that is about 2% to 10% hydrogen chloride in deionized water. Depending on the amount of agitation and the thickness of the filler glass that must be etched away, the duration of the wet etch can vary from about 0.5 to 4 hours. Of the original spacer slice 902, only permanent spacer columns 1301 remain.

Figure 14:
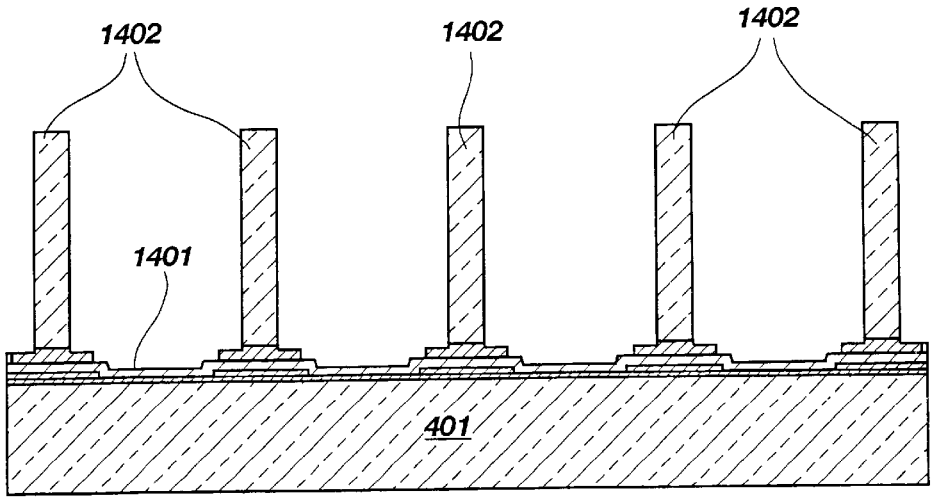
FIG. 14 depicts a cross-sectional view of the substrate/spacer assembly of FIG. 13 following an etch step which removes the protective sacrificial layer and any permanent spacer columns which were bonded thereto.

Finally, as depicted by FIG. 14, the protective sacrificial layer 502, which covers the future phosphor areas 1401 of the face plate, is etched away. If, for example, the sacrificial layer is aluminum metal, then a wet aluminum etch is used. Any unwanted permanent spacer columns attached to the protective layer are, thus, removed, leaving only final, permanent spacers 1402.

Figure 15:
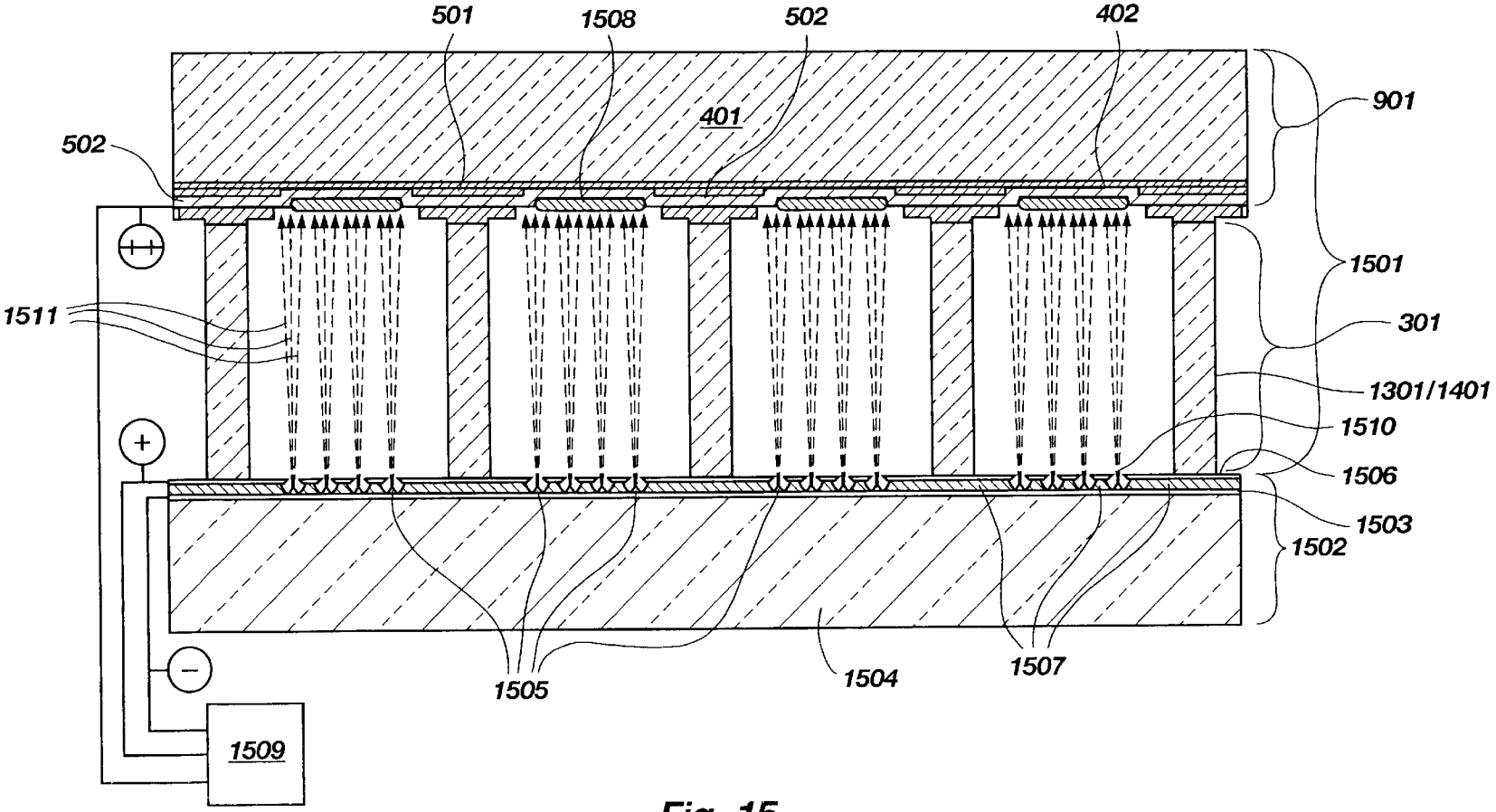
FIG. 15 depicts a cross-sectional view through a small portion of a field emission display having a base plate assembly and a face plate assembly with spacers anodically bonded thereto.

Referring now to FIG. 15, a cross-sectional view through a portion of a field emission flat-panel display, which incorporates a face plate assembly having spacer columns which have been anodically bonded thereto by the above-described process, is depicted. The display includes a face plate assembly 1501 and a representative base plate assembly 1502. For this particular display, the base plate assembly 1502 is formed by depositing a conductive layer 1503, such as silicon, on top of a glass substrate 1504. The conductive layer 1503 is then etched to form individual conically shaped microcathodes 1505, each of which serves as a field emission site on the glass substrate 1504. Each microcathode 1505 is located within a radially symmetrical aperture formed by etching, first, through a conductive gate layer 1506 and, then, through a lower insulating layer 1507. The face plate assembly 1501 incorporates a silicate glass substrate 301, an anti-reflective layer 302 (see FIG. 3), a black matrix 401 formed from a transition metal oxide layer, a transparent conductive layer 402, an oxidizable material patch 501 at each spacer column attachment site, and a glass spacer column 1301 anodically bonded to the oxidizable material patch 501 at each such attachment site. Each spacer column 1301 bears against an expanse of the gate layer 1506. In regions of the face plate not covered by the black matrix 401, phosphor dots 1508 have been deposited through one of many known deposition techniques (e.g., electrophoresis) or printing techniques (e.g., screen printing, ink jet, etc.) on the protective sacrificial layer 502. When a voltage differential, generated by voltage source 1509, is applied between a microcathode 1505 and its associated surrounding gate aperture 1510 in gate layer 1506, a stream of electrons 1511 is emitted toward the phosphor dots 1508 on the face plate assembly 1501 which are above the emitting microcathode 1505. The screen, which is charged via the transparent conductive layer 402 to a potential that is even higher than that applied to the gate layer 1506, functions as an anode by causing the emitted electrons to accelerate toward it. The microcathodes 1505 are matrix addressable via circuitry within the base plate (not shown) and, thus, can be selectively activated in order to display a desired image on the phosphor-coated screen.

It should be evident that the heretofore described process is capable of forming a face plate for internally evacuated flat-panel displays which have spacer support structures anodically bonded to the face plate. Such face plates can be efficiently and accurately manufactured via this process.

Although only several variations of a single basic embodiment of the process are described, as are a single embodiment of a face plate and spacer assembly manufactured by that process and a single embodiment of a flat-panel field emission display incorporating such a face plate and spacer assembly, it will be obvious to those having ordinary skill in the art that changes and modifications may be made thereto without departing from the scope and the spirit of the process and products manufactured using the process as hereinafter claimed. For example, although for a preferred embodiment of the process it is deemed preferable to anodically bond spacer support columns to the face plate, it would also be possible to anodically bond the spacer support columns to the base plate. The latter process, however, would require protection of the microcathodes. The added complexity required to protect the microcathodes during each steps would make such a process alternatively inadvisable.

What is claimed is:

1. A process for fabricating a flat panel display having a laminar silicate glass substrate and having a plurality of spacers, each spacer having a surface, the process comprising:

covering the substrate with an anti-reflective layer;

covering the anti-reflective layer with a light-absorbing layer;

patterning the light-absorbing layer to form a generally opaque matrix serving as a contrast mask, the matrix exposing portions of the anti-reflective layer;

covering the matrix and the exposed portions of the anti-reflective layer with a transparent conductive layer;

depositing an oxidizable material layer over the underlying transparent conductive layer;

patterning the oxidizable material layer forming oxidizable material for spacer attachment sites in exposed portions of the underlying transparent conductive layer;

positioning the surface of each spacer in contact with an exposed portion of the transparent conductive layer; and anodically bonding the surface of each spacer to a portion of the conductive layer.

2. The process of claim 1, further comprising:

depositing a protective sacrificial layer over portions of the oxidizable material layer and over the exposed portions of the transparent conductive layer; and patterning the protective sacrificial layer to expose an oxidizable material patch.

3. The process of claim 2, wherein the protective sacrificial layer is selected from the group consisting of cobalt oxide and aluminum, chromium, cobalt, and molybdenum metals.

4. The process of claim 2, wherein patterning the protective sacrificial layer includes a channel surrounding the oxidizable material layer at each spacer attachment site, the channel exposing the underlying transparent conductive layer.

5. The process of claim 1, wherein the spacer attachment sites are electrically interconnected during the anodically bonding the surface of each spacer by the transparent conductive layer.

6. The process of claim 1, wherein the anti-reflective layer has an optical thickness of about one-quarter a wavelength of light in a middle of a visible spectrum.

7. The process of claim 6, wherein the anti-reflective layer is about 650 Å thick and comprises silicon nitride.

8. The process of claim 1, wherein the light-absorbing layer comprises a colored transition metal oxide.

9. The process of claim 8, further comprising:

preparing a glass-fiber bundle having a set of permanent glass fibers, each glass fiber surrounded by filler glass, the filler glass being selectively etchable with respect to the permanent glass fibers for forming the plurality of spacers;

sintering the glass-fiber bundle;

drawing the glass-fiber bundle;

cutting the glass-fiber bundle into glass-fiber bundle sections;

forming a block by stacking cut glass-fiber bundle sections;

sintering the stacked sections forming the block;

slicing the block to form a uniformly-thick laminar slice having a pair of opposing major surfaces; and polishing both major surfaces of the laminar slice to a final thickness which corresponds to a desired spacer length for forming a spacer of the plurality of spacers.

10. The process of claim 9, wherein each permanent glass fiber is clad with filler glass, wherein each filler glass clad permanent glass fiber is surrounded by six other fibers clad with filler glass, and wherein the filler clad glass fibers together form a repeating, hexagonal fiber bundle.

11. The process of claim 9, wherein the glass fibers are cubically packed as a repeating array, each permanent glass fiber surrounded by eight filler glass fibers having identical cross-sections.

12. The process of claim 8, wherein the colored transition metal oxide is cobalt oxide having a color ranging from dark blue to black.

13. The process of claim 1, wherein patterning of the light-absorbing layer includes alignment marks in the light-absorbing layer.

14. The process of claim 1, wherein the transparent conductive layer comprises a material selected from the group consisting of indium tin oxide and tin oxide.

15. The process of claim 1, wherein the oxidizable material layer comprises a material selected from the group consisting of silicon and oxidizable metals.

16. The process of claim 1, wherein the oxidizable material layer is deposited via chemical vapor deposition.

17. The process of claim 1, wherein the oxidizable material layer is deposited via physical vapor deposition.

18. The process of claim 1, wherein all the spacer attachment sites are situated in opaque matrix regions.

19. A process for fabricating a face plate assembly for an evacuated flat panel display having a laminar substrate and a plurality of spacers, the process comprising:

coating the substrate with an anti-reflective layer;

depositing a substantially opaque layer over the anti-reflective layer;

patterning the substantially opaque layer forming a substantially opaque matrix surrounding transparent regions of the anti-reflective layer;

depositing a transparent conductive material layer over the substantially opaque matrix and over transparent regions of the anti-reflective layer;

depositing an oxidizable material layer over the transparent conductive material layer;

patterning the oxidizable material layer to leave oxidizable material patch forming a plurality of spacer attachment sites;

depositing a protective sacrificial layer over the oxidizable material patch and over portions of the transparent conductive material layer;

patterning the protective sacrificial layer to expose portions of the oxidizable material patch at each spacer attachment site;

placing an array of unattached glass spacers generally perpendicular to the substrate, the unattached glass spacers having uniform lengths and being imbedded within a filler glass matrix;

positioning the array of unattached glass spacers having each spacer attachment site contacting a contacting end of a glass spacer; and anodically bonding the glass spacers to the spacer attachment sites.

20. The process of claim 19, further comprising polishing an upper surface of the spacer array.

21. The process of claim 20, wherein polishing is performed utilizing both abrasive action and chemical etchant action simultaneously.

22. The process of claim 19, wherein the laminar substrate is silicate glass.

23. The process of claim 22, further comprising:

subjecting the substrate to a thermal cycle for dimensional stabilization thereof.

24. The process of claim 19, wherein the protective sacrificial layer is selected from the group consisting of cobalt oxide and aluminum, chromium, cobalt, and molybdenum metals.

25. The process of claim 19, wherein patterning of the protective sacrificial layer includes a channel surrounding each oxidizable material patch, the channel exposing the transparent conductive material layer.

26. The process of claim 19, wherein all the spacer attachment sites are interconnected during the anodic bonding of the glass spacers to the attachment spacer sites by the transparent conductive material layer.

27. The process of claim 19, wherein the anti-reflective layer has an optical thickness of about one-quarter the wavelength of light in the middle of the visible spectrum.

28. The process of claim 19, wherein the anti-reflective layer is about 650 Å thick, and comprises silicon nitride.

29. The process of claim 19, further comprising:

covering the anti-reflective layer with a substantially opaque layer, wherein the anti-reflective layer comprises a colored transition metal oxide.

30. The process of claim 29, wherein the colored transition metal oxide layer is cobalt oxide having a color ranging from dark blue to black.

31. The process of claim 19, wherein patterning of the substantially opaque layer includes alignment marks in the substantially opaque layer for deposition of an optically aligned phosphor material.

32. The process of claim 19, wherein the transparent conductive material layer comprises a material selected from the group consisting of indium tin oxide and tin oxide.

33. The process of claim 19, wherein the oxidizable material layer comprises a material selected from the group consisting of silicon and oxidizable metals.

34. The process of claim 19, wherein each spacer attachment site is in an opaque matrix region.

35. The process of claim 19, wherein the array of unattached glass spacers is prepared in a process including:

preparing a glass-fiber bundle having a set of permanent glass fibers, each glass fiber surrounded by filler glass fibers, the filler glass fibers being selectively etchable with respect to the permanent glass fibers;

sintering the glass-fiber bundle;

drawing the glass-fiber bundle;

cutting the glass-fiber bundle into sections;

forming a block by stacking cut glass-fiber bundle sections and sintering the stacked sections;

slicing the block to form a uniformly-thick laminar slice having a pair of opposing major surfaces; and polishing both major surfaces of the laminar slice to a final thickness which corresponds to a desired spacer length.

36. The process of claim 35, wherein for cylindrical solid spacers, each permanent glass fiber is clad with filler glass, and each filler glass clad permanent glass fiber is surrounded by six other identically clad fibers which together form a repeating, hexagonally-packed unit through a cross-section of the glass fiber bundle.

37. The process of claim 35, wherein for spacer support columns having a square cross-section, the glass fibers are cubically packed as an array having each permanent glass fiber surrounded by eight filler glass fibers having identical cross-sections.

38. The process of claim 19, wherein the anodically bonding includes:

heating the substrate and the contacting array of glass spacers;

applying a potential between the transparent conductive material layer and a non-contacting end of each glass spacer, the transparent conductive material layer being positively biased with respect to the non-contacting end of each glass spacer sufficient to cause oxygen ions from the contacting end of each glass spacer to migrate to the oxidizable material patch, causing at least a portion of the oxidizable material patch to oxidize and form an oxide interface bonding of the glass spacers to the spacer attachment sites.

39. The process of claim 38, wherein electrical contact is made to the non-contacting end of each glass spacer via a metal foil electrode which covers an entire array of unattached glass spacers.

40. The process of claim 38, wherein, during the anodic bonding, the substrate and the contacting array of glass spacers are heated to about a transition temperature of the glass from which the glass spacers are formed.

41. The process of claim 38, wherein a potential within a range of about 500 to 1,000 volts is applied between the transparent conductive material layer and the non-contacting end of each glass spacer during the anodic bonding.

42. The process of claim 38, wherein, during the anodic bonding, extra spacers and filler glass anodically bond to the protective sacrificial layer.

43. The process of claim 42, further comprising:

etching away the filler glass;

etching away the protective sacrificial layer and extra spacers; and depositing luminescent phosphor on portions of the substrate not covered by the substantially opaque matrix.

* * * * *

UNITED STATES PATENT AND TRADEMARK OFFICE

CERTIFICATE OF CORRECTION

PATENT NO. : 6,716,080 B2
DATED : April 6, 2004
INVENTOR(S) : James J. Hoffman et al.

It is certified that error appears in the above-identified patent and that said Letters Patent is hereby corrected as shown below:

Title page,
Item [60], Related U.S. Application Data, change "division" to -- divisional --

Column 3,
Lines 35 and 37, change "d" to -- *d* --

Column 15,
Line 32, change "the" to -- a --
Line 33, change both occurrences of "the" to -- a --

Signed and Sealed this

Eighth Day of March, 2005

JON W. DUDAS
*Director of the United States Patent and Trademark Office*